US009028018B2

(12) United States Patent
Tsai

(10) Patent No.: US 9,028,018 B2
(45) Date of Patent: May 12, 2015

(54) DRAWER ASSEMBLY

(71) Applicant: Dongguan Master United Plastic & Hardware Products Co., Ltd., Dongguan, Guandong Province (CN)

(72) Inventor: Tsung-Yu Tsai, Changhua (TW)

(73) Assignee: Dongguan Master United Plastic & Hardware Products Co., Ltd., Dongguan, Guandong Province (CN)

( * ) Notice: Subject to any disclaimer, the term of this patent is extended or adjusted under 35 U.S.C. 154(b) by 0 days.

(21) Appl. No.: 13/761,655

(22) Filed: Feb. 7, 2013

(65) Prior Publication Data

US 2014/0217876 A1 Aug. 7, 2014

(51) Int. Cl.
*A47B 88/16* (2006.01)

(52) U.S. Cl.
CPC ..... *A47B 88/16* (2013.01); *A47B 2210/01* (2013.01); *A47B 2210/04* (2013.01); *A47B 2210/19* (2013.01)

(58) Field of Classification Search
CPC ..... A47B 47/00; A47B 55/02; A47B 67/00; A47B 67/04; A47B 88/12; A47B 88/16; A47B 88/02; A47B 2088/0403; A47B 2088/04; A47B 2088/0448; A47B 2210/0018; A47B 2210/0024; A47B 2210/04
USPC ..... 312/330.1, 334.1, 334.27, 350, 333, 312/334.44; 211/150, 151, 126.15, 134, 211/153, 133.2, 133.5, 181.1
See application file for complete search history.

(56) References Cited

U.S. PATENT DOCUMENTS

| | | | | |
|---|---|---|---|---|
| 1,748,843 | A * | 2/1930 | Kuckel | 312/408 |
| 1,896,307 | A * | 2/1933 | Hatch | 312/408 |
| 2,466,033 | A * | 4/1949 | Martin | 312/323 |
| 2,466,360 | A * | 4/1949 | Bitney | 108/137 |
| 5,642,924 | A * | 7/1997 | Wohlrab et al. | 312/408 |
| 6,732,662 | B2 * | 5/2004 | Welch et al. | 108/109 |
| 7,063,219 | B2 * | 6/2006 | Fann et al. | 211/74 |
| 7,703,453 | B2 * | 4/2010 | Hughes | 126/339 |
| 8,616,386 | B1 * | 12/2013 | Tsai | 211/126.15 |
| 2007/0158289 | A1 * | 7/2007 | Chen | 211/186 |
| 2010/0000514 | A1 * | 1/2010 | Baker et al. | 126/339 |

FOREIGN PATENT DOCUMENTS

| | | |
|---|---|---|
| TW | M330071 | 4/2008 |

* cited by examiner

*Primary Examiner* — Daniel J Troy
*Assistant Examiner* — Andrew Roersma
(74) *Attorney, Agent, or Firm* — Muncy, Geissler, Olds & Lowe, P.C.

(57) ABSTRACT

A drawer assembly includes a carrier frame and a sliding basket mounted in the carrier frame and movable in forward-backward direction relative to the carrier frame. The carrier frame includes a front open frame, a rear open frame, a first supporting rod and a second supporting rod. The first and second supporting rods are respectively connected between the front open frame and the rear open frame. The sliding basket includes a first limiter member disposed at one lateral side relative to the first supporting rod and defining a first concave portion and a first stop portion connected to the first concave portion. The first stop portion is disposed at the bottom side of the first supporting rod. Thus, the sliding basket is escaping out of the carrier frame in upward direction.

6 Claims, 6 Drawing Sheets

DRAWER ASSEMBLY

BACKGROUND OF THE INVENTION

1. Field of the Invention

The present invention relates to drawer structures and more particularly, to a drawer assembly, which comprises a carrier frame and a sliding basket that are structurally matched, preventing the sliding basket from being over-extracted or over-pushed.

2. Description of the Related Art

There are two types of drawer structures, namely railed drawer structures and rail-less drawer structures. The present invention related to rail-less drawer structures rather than railed drawer structures, and thus functions and purposes of railed drawer structures are not described herein for the sake of brevity. Rail-less drawer structures are disclosed in the prior art, such as Taiwan utility model patent M330071, which discloses a holder drawer structure comprising a holder and a drawer. Two supporting frames are disposed at the bottom of the holder. The bottom of the holder carries the drawer. A hook rod-shaped position-limiting guiding portion is disposed at the top of the holder and engaged with the drawer when the drawer is pulled outward excessively, so as to prevent the drawer from sliding out of the holder drawer structure. The two supporting frames are equipped with two auxiliary lateral rods which are disposed on two sides of the drawer, respectively. However, the position-limiting functionality of the two auxiliary lateral rods is restricted to the two sides of the drawer. As a result, once the drawer is pulled outward, the front end of the drawer will automatically tilt downward.

SUMMARY OF THE INVENTION

The present invention has been accomplished under the circumstances in view. It is the main object of the present invention to provide a drawer assembly, which comprises a carrier frame and a sliding basket. The carrier frame comprises a panel member, a front open frame, a rear open frame, a first supporting rod and a second supporting rod. The panel member has the opposing front and rear sides thereof respectively connected to the outer side of the front open frame and the outer side of the rear open frame. Further, the panel member is disposed at the top side relative to the front open frame and the rear open frame. The first supporting rod and the second supporting rod are respectively connected to the inner side of the front open frame and the inner side of the rear open frame, and disposed at the bottom side relative to the front open frame and the rear open frame. The sliding basket is mounted in the carrier frame and slidable forwards and backwards relative to the carrier frame. The sliding basket comprises a basket body, and a first limiter member connected to the basket body. The first limiter member is disposed at one lateral side relative to the first supporting rod. The first limiter member comprises a first concave portion, and a first stop portion connected to the first concave portion and disposed at the bottom side relative to the first supporting rod.

Thus, subject to the aforesaid structural arrangement, the drawer assembly of the present invention prevents the sliding basket from escaping out of the carrier frame.

Preferably, the sliding basket further comprises a second limiter member connected to the basket body. The second limiter member is disposed at one lateral side relative to the second supporting rod. The second limiter member comprises a second concave portion, and a second stop portion connected to the second concave portion. The second stop portion is disposed at the bottom side relative to the second supporting rod. Subject to the arrangement of this second limiter member, the sliding stability of the sliding basket is enhanced.

Preferably, the first supporting rod and the second supporting rod each have an inner side facing each other. The first limiter member and the second limiter member are respectively disposed at an inner side relative to the first supporting rod and the second supporting rod. Thus, the sliding basket cam be pulled out of the carrier frame or pushed back into the inside of the carrier frame along the inner side of the first supporting rod and the inner side of the second supporting rod, avoiding deviation.

DETAILED DESCRIPTION OF THE INVENTION

Figure 1:
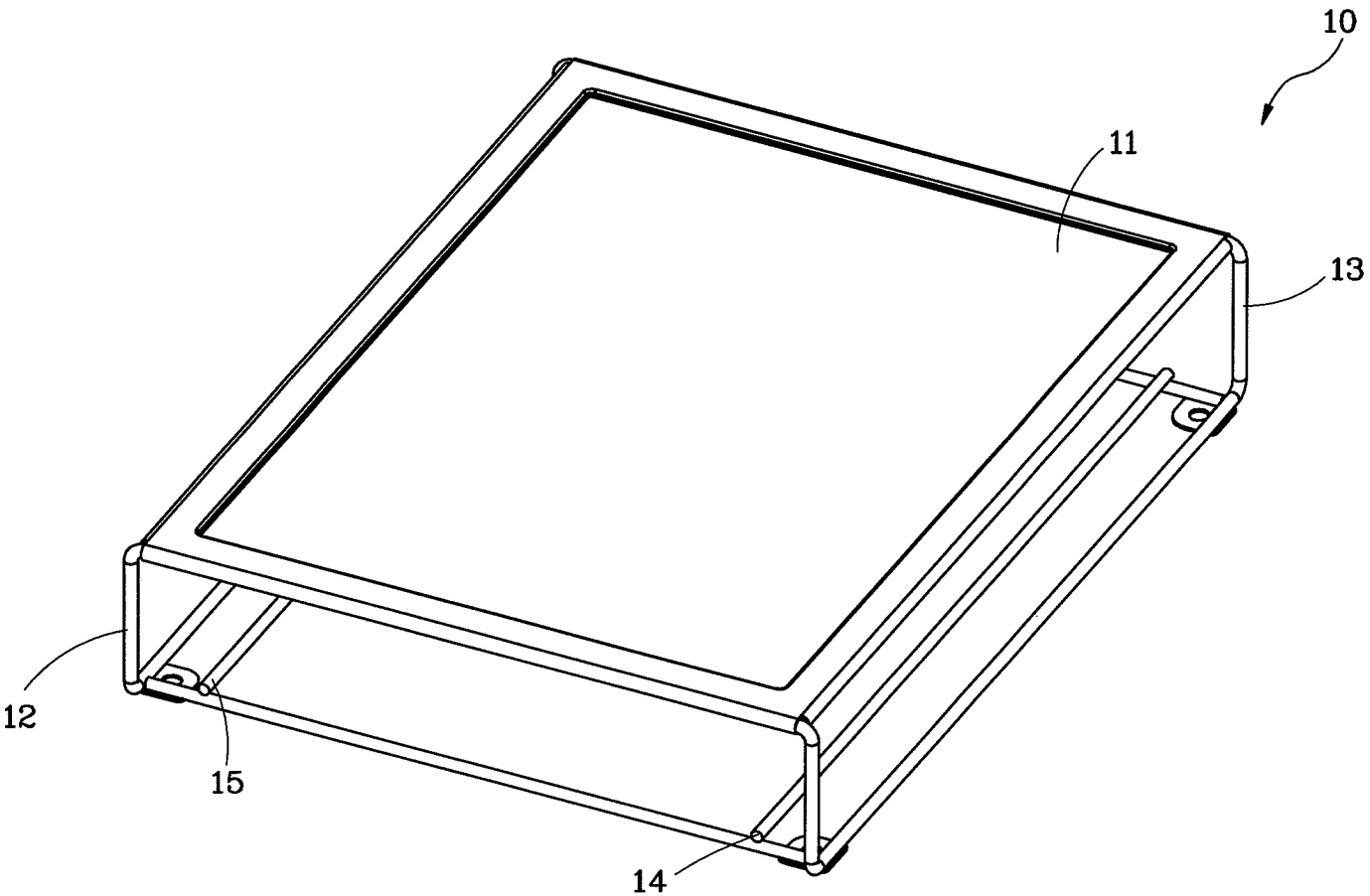
FIG. 1 is an oblique top elevational view of a carrier frame for drawer assembly in accordance with the present invention.

Referring to FIG. 1, a carrier frame for drawer assembly in accordance with the present invention is shown. As illustrated, the carrier frame 10 is preferably made out of stainless steel rods, iron rods, or galvanized iron wire rods, comprising a panel member 11, a front open frame 12, a rear open frame 13, a first supporting rod 14 and a second supporting rod 15. The panel member 11 connects the top sides of the front and rear open frames 12 and 13, and is abutted against the peripheries of the front and rear open frames 12 and 13. The front open frame 12 and the rear open frame 13 are respectively disposed at the opposing front and rear sides of the panel member 11. The first supporting rod 14 and the second supporting rod 15 are respectively connected between the front open frame 12 and the rear open frame 13, and disposed at the bottom side of the front open frame 12 and the rear open frame 13. Further, the first supporting rod 14 and the second supporting rod 15 are arranged to face each other at a predetermined interval.

Figure 2:
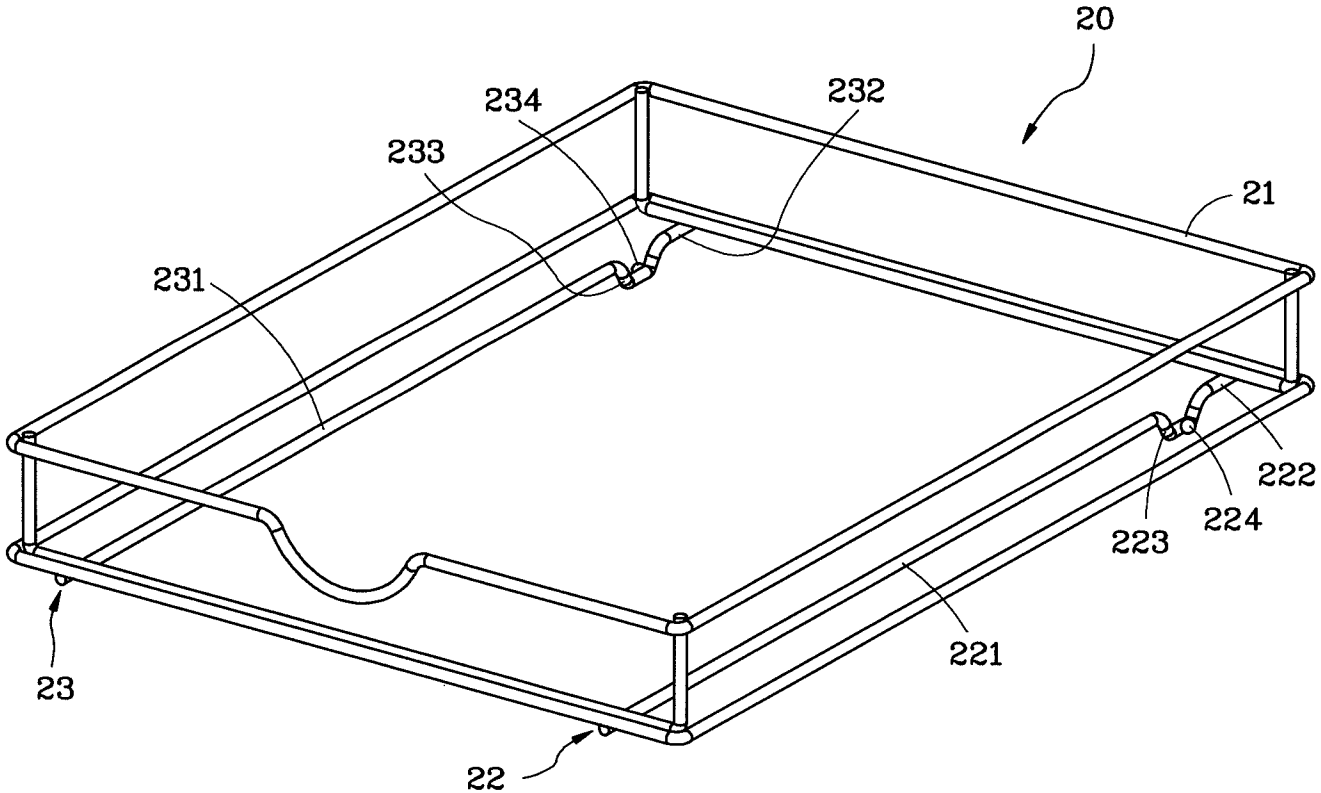
FIG. 2 is an oblique top elevational view of a sliding basket for drawer assembly in accordance with the present invention.
Figure 3:
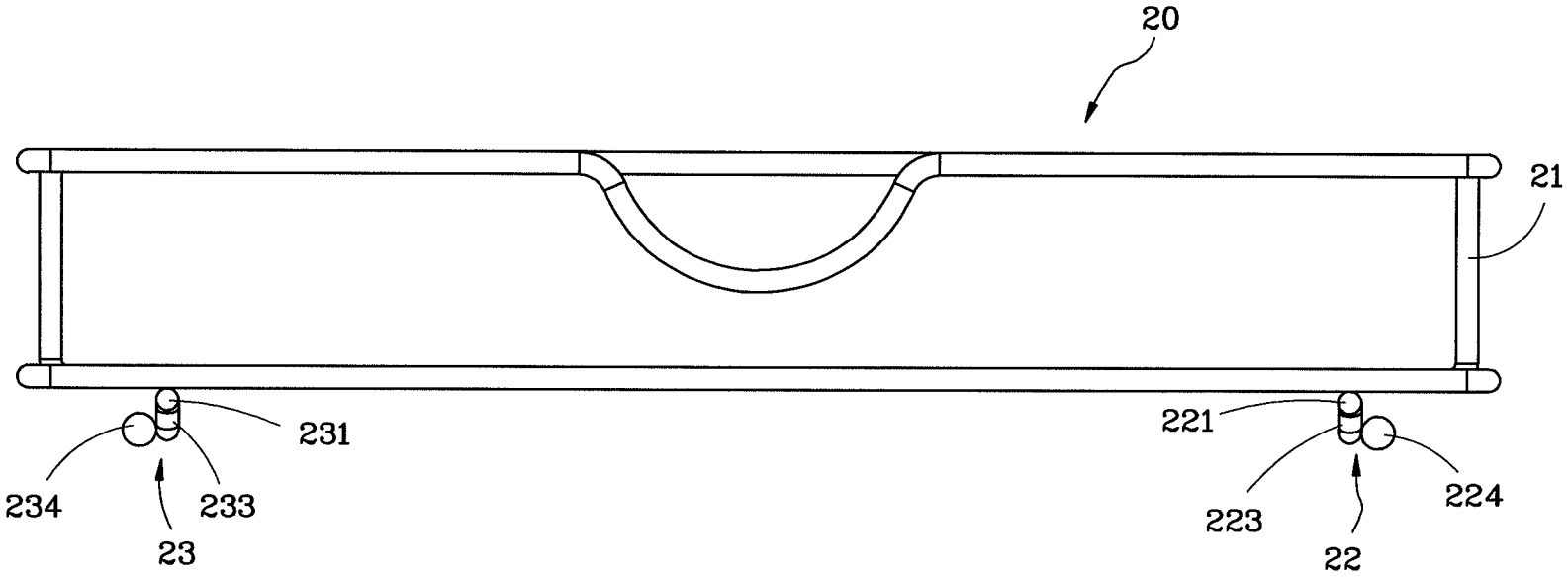
FIG. 3 is a schematic front view of the sliding basket shown in FIG. 2.

Referring to FIG. 2, a sliding basket for drawer assembly in accordance with the present invention is shown. As illustrated, the sliding basket 20 is preferably made out of stainless steel rods, iron rods, or galvanized iron wire rods, comprising a basket body 21, a first limiter member 22 and a second limiter member 23. In this embodiment, the basket body 21 is illustrated in the form of a simple framework. In actual practice, other structures can be arranged inside the basket body 21, for example, a panel member or a partition structure can be arranged at the bottom side of the basket body 21, i.e., the structure of the basket body 21 is not limited to what is shown in FIG. 2.

The first limiter member 22 and the second limiter member 23 are mounted in the basket body 21 and disposed at the bottom side of the basket body 21.

The first limiter member 22 defines a first long straight portion 221, a first short straight portion 222, a first concave portion 223, and a first stop portion 224. The first long straight portion 221 has its front end connected to the front side of the basket body 21. The first short straight portion 222 has its rear end connected to the rear side of the basket body 21. The first concave portion 223 has two opposite ends of the top side thereof respectively connected to the rear end of the first long straight portion 221 and the front end of the first short straight portion 22. The first stop portion 224 is connected to the bottom side of the first concave portion 223, and disposed at one lateral side relative to the first concave portion 223.

The second limiter member 23 defines a second long straight portion 231, a second short straight portion 232, a second concave portion 233, and a second stop portion 234. The second long straight portion 231 has its front end connected to the front side of the basket body 21. The second short straight portion 232 has its rear end connected to the rear side of the basket body 21. The second concave portion 233 has two opposite ends of the top side thereof respectively connected to the rear end of the second long straight portion 231 and the front end of the second short straight portion 23. The second stop portion 234 is connected to the bottom side of the second concave portion 233, and disposed at one lateral side relative to the second concave portion 233.

In this embodiment, the first stop portion 224 and the second stop portion 234 are respectively made in the form of a sphere, and respectively directly welded to the first concave portion 223 and the second concave portion 233 at one lateral side.

Figure 4:
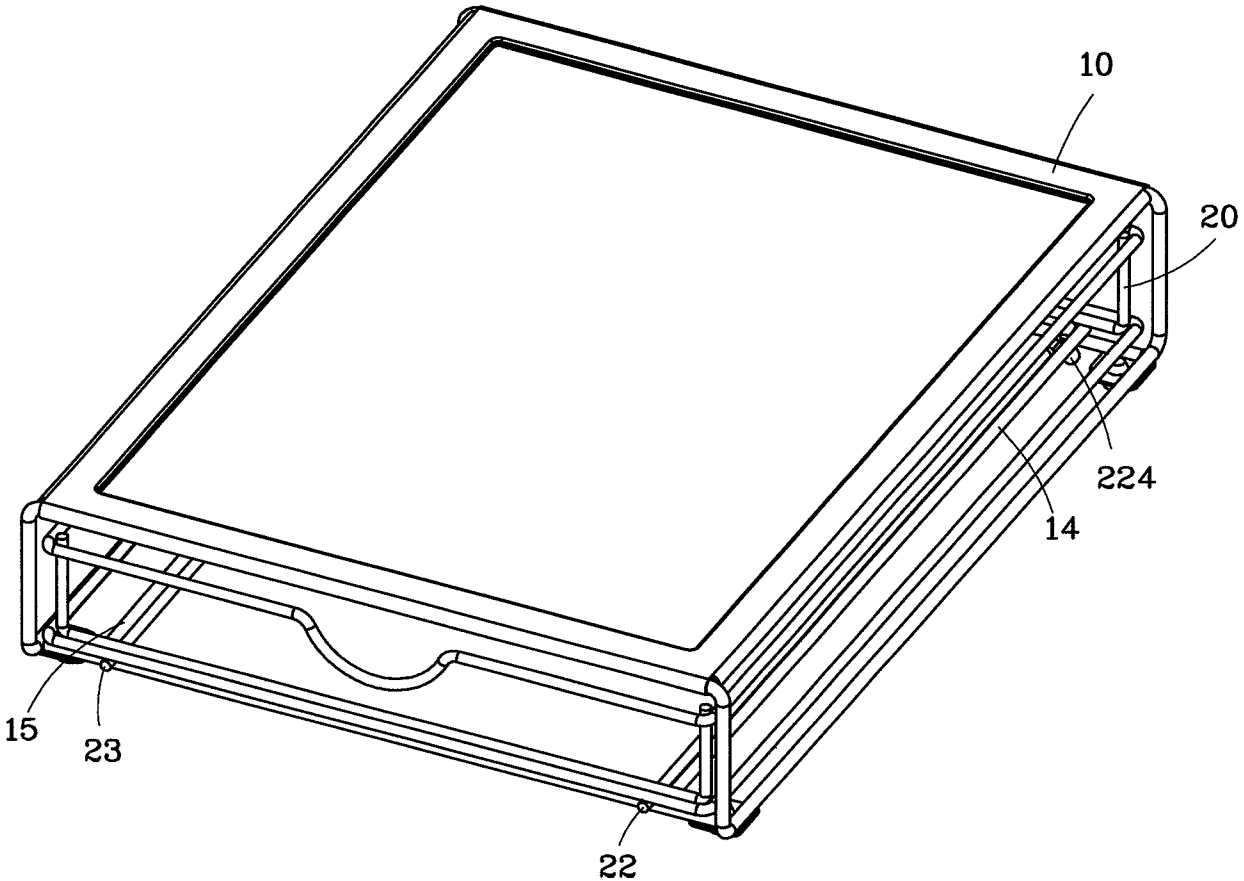
FIG. 4 is an oblique top elevational view of a drawer assembly in accordance with the present invention.
Figure 5:
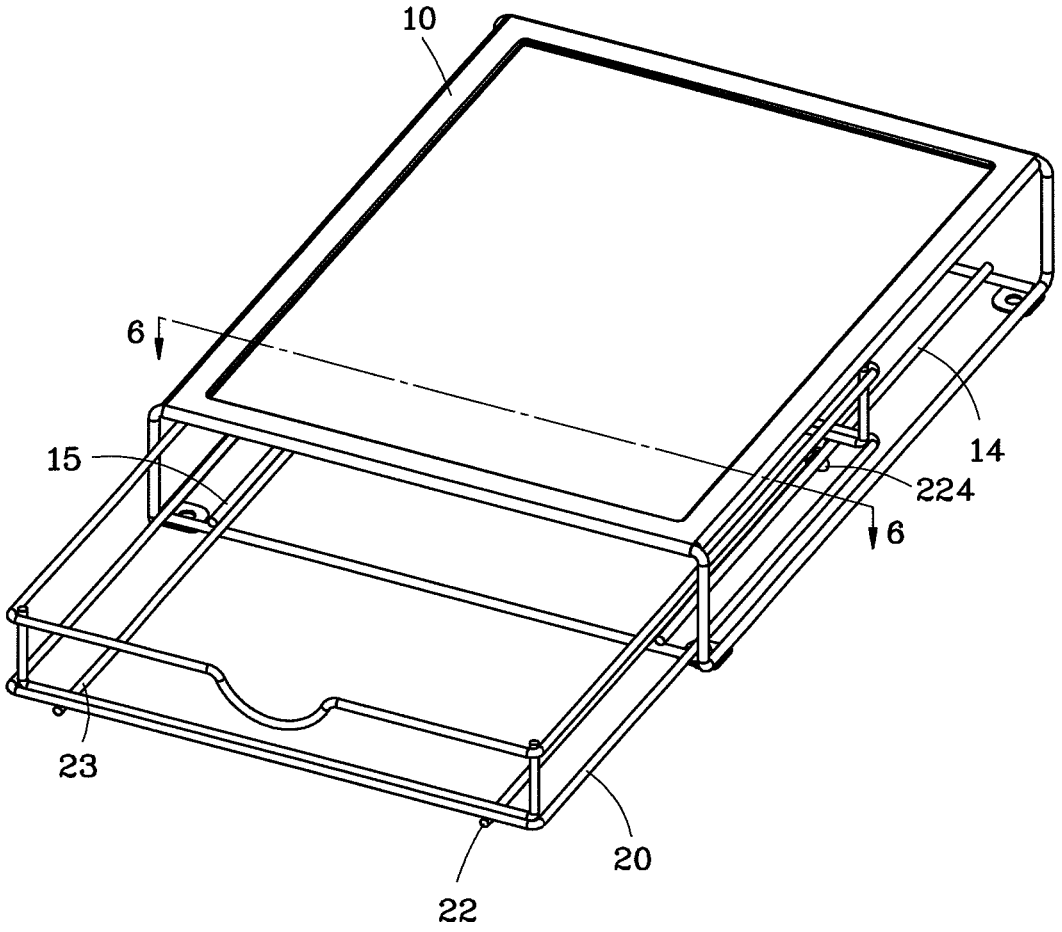
FIG. 5 corresponds to FIG. 4, illustrating the sliding basket partially pulled out of the carrier frame.
Figure 6:
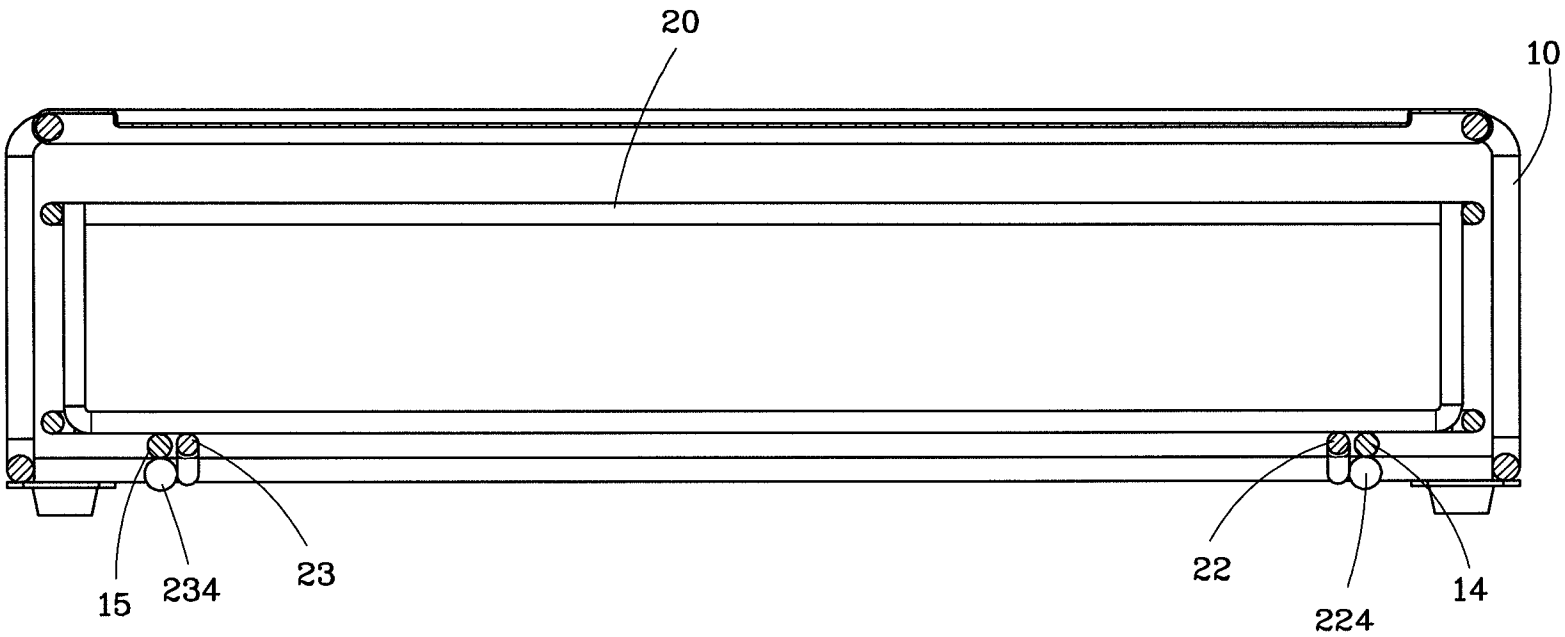
FIG. 6 is a sectional view taken along line 6-6 of FIG. 5.

FIG. 4 illustrates the drawer assembly in a close position. FIG. 5 illustrates the sliding basket of the drawer assembly partially pulled out of the carrier frame. FIG. 6 is a sectional view of the drawer assembly. As shown in FIGS. 4-6, the sliding basket 20 of FIG. 2 is installed in the carrier frame 10 of FIG. 1. Thus, the first limiter member 22 and second limiter member 23 of the sliding basket 20 are respectively disposed at an inner side relative to the first supporting rod 14 and second supporting rod 15 of the carrier frame 10 to prohibit vibration of the sliding basket 20 when the sliding basket 20 is being pulled out of the carrier frame 10 or pushed into the inside of the carrier frame 10. Further, the first stop portion 224 and the second stop portion 234 are respectively disposed at the bottom side relative to the first supporting rod 14 and the second supporting rod 15, preventing the sliding basket 20 from escaping out of the carrier frame 10 in upward direction.

In actual practice, if you simply need to prevent the sliding basket 20 from escaping out of the carrier frame 10 in upward direction, the sliding basket 20 can simply has the first limiter member 22 mounted therein and the second limiter member 23 can be omitted. Further, the first stop portion 224 and the second stop portion 234 are preferably made in the form of a metal sphere. However, in actual practice, the first stop portion 224 and the second stop portion 234 can be respectively made in the form of a post, or respectively directly extended from the bottom side the first concave portion 223 and the bottom side of the second concave portion 233, keeping the first stop portion 224 and the second stop portion 234 in a perpendicular manner or approximately in a perpendicular manner relative to the first concave portion 223 and the bottom side of the second concave portion 233. In this case, the first limiter member 22 and the second limiter member 23 can be respectively integrally made in a single piece. Further, if the basket body 21 of the sliding basket 20 has means that connects the first concave portion 223 and the first stop portion 224, the first long straight portion 221 and the first short straight portion 222 can be omitted. Further, because the structure of the second limiter member 23 is similar to the structure of the first limiter member 22, the second long straight portion 231 and the second short straight portion 232 can be omitted if the second limiter member 23 is configured to provide connection means in the basket body 21 of the sliding basket 20 to connect the second concave portion 233 and the first stop portion 234.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A drawer assembly, comprising:

a carrier frame comprising a panel member, a front open frame, a rear open frame, a first supporting rod and a second supporting rod, said panel member having opposing front and rear sides thereof respectively connected to said front open frame and said rear open frame and disposed at a top side of said front open frame and a top side of said rear open frame, said first supporting rod and said second supporting rod being respectively connected to an inner side of said front open frame and an. inner side of said rear open frame and respectively disposed at a bottom side of said front open frame and a bottom side of said rear open frame; and a sliding basket mounted in said carrier frame and movable forwards and backwards relative to said carrier frame, said sliding basket comprising a basket body defining opposing front side and rear side and a first limiter member connected to said basket body, said first limiter member comprising a first concave portion and a first stop portion connected to said first concave portion, said first concave portion being disposed at a first lateral side of said first supporting rod, said first concave portion and said first stop portion jointly forming a corner, said first supporting rod being disposed in said corner, said first stop portion being disposed at a bottom side of said first supporting rod, a front side of said first stop portion being adjacent to a second lateral side of said first supporting rod, said first and second lateral sides being opposite to each other, said first stop portion being a sphere.

2. The drawer assembly as claimed in claim 1, wherein said sliding basket further comprises a second limiter member connected to said basket body, said second limiter member comprising a second concave portion and a second stop portion connected to said second concave portion, said second concave portion being disposed at a first lateral side of said second supporting rod, said second concave portion and said second stop portion jointly forming a corner, said second supporting rod being disposed in said corner, said second stop portion being disposed at a bottom side of said second supporting rod, a front side of said second stop portion being adjacent to a second lateral side of said second supporting rod, said first and second lateral sides being opposite to each other.

3. The drawer assembly as claimed in claim 2, wherein said second stop portion is a sphere.

4. The drawer assembly as claimed in claim 2, wherein said first supporting rod and said second supporting rod each have an inner side thereof respectively facing each other; said first limiter member and said second limiter member are respectively disposed at an inner side relative to said first supporting rod and said second supporting rod.

5. The drawer assembly as claimed in claim 2, wherein said first limiter member further comprises a first long straight portion and a first short straight portion, said first long straight portion having opposing front end and rear end, the front end of said first long straight portion being connected to the front side of said basket body, said first short straight portion defining opposing front end and rear end, the rear end of said first short straight portion. being connected to the rear side of said basket body, said first concave portion having two opposing ends of a top side thereof respectively connected to the rear end of said first long straight portion and the front end of said first short straight portion, said second limiter member further comprising a second long straight portion and a second short straight portion, said second long straight portion defining opposing front end and rear end, the front end of said second long straight portion being connected to the front side of said basket body, said second short straight portion defining opposing front end and rear end, the rear end of said second short straight portion being connected to the rear side of said basket body, said second concave portion having opposing ends of a top side thereof respectively connected to the rear end of said second long straight portion and the front end of said second short straight portion.

6. The drawer assembly as claimed in claim 1, wherein said first limiter member further comprises a first long straight portion and a first short straight portion, said first long straight portion having opposing front end and rear end, the front end of said first long straight portion being connected to the front side of said basket body, said first short straight portion defining opposing front end and rear end, the rear end of said first short straight portion being connected to the rear side of said basket body, said first concave portion having two opposing ends of a top side thereof respectively connected to the rear end of said first long straight portion and the front end of said first short straight portion.

* * * * *